United States Patent [19]

Evers

[11] 4,288,014

[45] Sep. 8, 1981

[54] DANCER ROLL ASSEMBLY

[75] Inventor: Jack R. Evers, Torrance, Calif.

[73] Assignee: Developak Corporation, Redondo Beach, Calif.

[21] Appl. No.: 76,446

[22] Filed: Sep. 17, 1979

[51] Int. Cl.[3] ..... B65H 25/04

[52] U.S. Cl. ..... 226/44

[58] Field of Search ..... 226/44, 40, 30, 31, 226/11, 113, 118; 242/55.01

[56] References Cited

U.S. PATENT DOCUMENTS

| | | | |
|---|---|---|---|
| 2,102,843 | 12/1937 | Gwynne | 242/55.01 |
| 3,410,468 | 11/1968 | Zobenica | 226/44 |
| 3,501,075 | 3/1970 | Scharf | 226/40 |
| 3,998,368 | 12/1976 | Hackney | 226/44 |

*Primary Examiner*—Edward J. McCarthy

*Attorney, Agent, or Firm*—Charles E. Brown

[57] ABSTRACT

This relates to a dancer roll assembly wherein there are a pair of dancer roll assemblies disposed in side-by-side relation and each vertically disposed. Each dancer roll assembly includes an upper shaft and a lower shaft having spaced sprockets thereon which are vertically aligned and over which are engaged belts. Each pair of belts carries a dancer doll for vertical movement under the influence of a tensioned web passed around the dancer roll. The upper shaft is a control shaft and has connected thereto a pneumatic control motor which resists the rotation of the shaft and thus resists the upward movement of the dancer roll. After the dancer roll has moved to an uppermost permitted position, the pneumatic motor is actuated to rotate the upper shaft and thus return the dancer roll to its lowermost starting position. The tension on the web is controlled by controlling the air pressure to the air motor.

9 Claims, 3 Drawing Figures

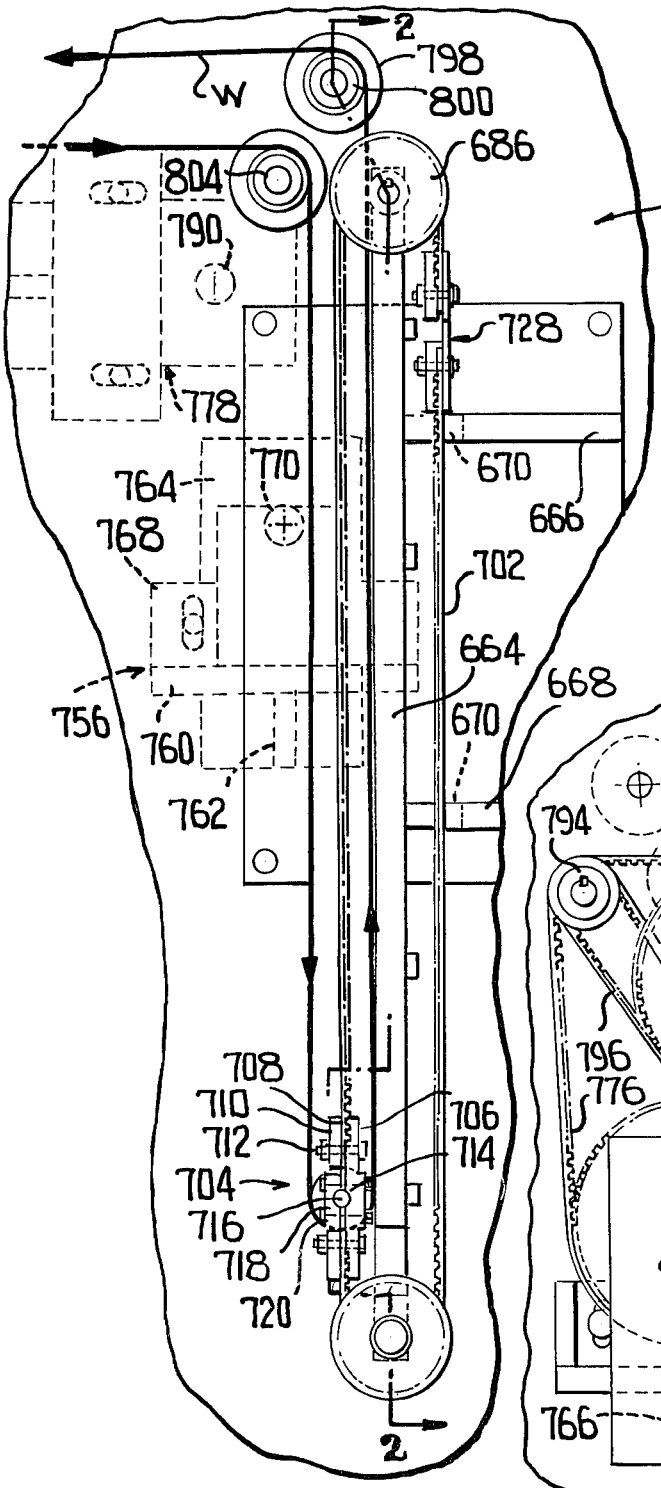
FIG. 1
FIG. 3
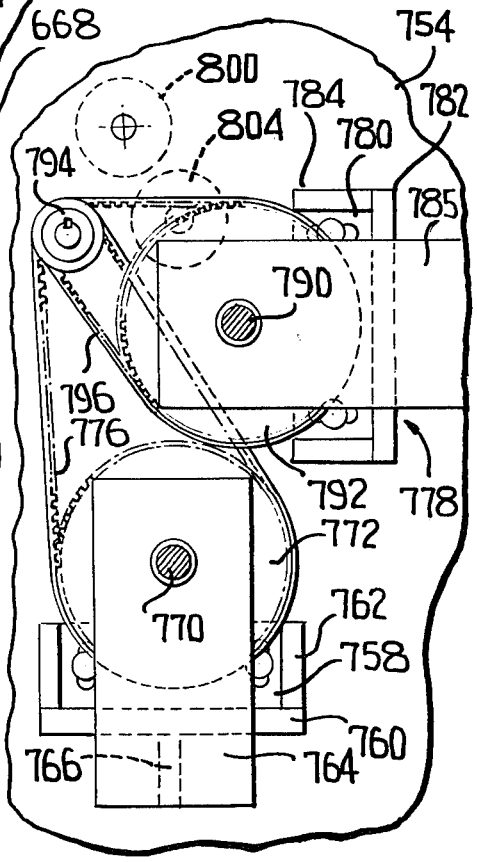

DANCER ROLL ASSEMBLY

This invention relates in general to new and useful improvements in dancer roll assemblies for tensioning webs, and more particularly to a dancer roll assembly wherein two such assemblies are mounted in side-by-side relation.

In accordance with this invention, it is proposed to provide a dancer roll assembly wherein the moving parts are as light as possible to thereby accommodate the acceleration of the web which is accelerated to when being payed out on the order of 2G.

In accordance with this invention, the dancer roll assembly includes an upper shaft and a lower shaft having axially spaced sprockets thereon and the sprockets being vertically aligned with a light weight timing belt engaged over the sprockets. The timing belts carry a dancer roll shaft on which there is mounted for rotation a dancer roll. A web passes over an idler roll, down around the dancer roll and back up around another idler roll so as to have the web doubled with respect to the dancer roll.

In order that the dancer roll may tension the web when the web is drawn, upward movement of the dancer roll is resisted by a control device which is coupled to one of the shafts. Most specifically, an air actuator or motor is coupled to the upper shaft with the motor being operable in one direction for a limited degree of rotation and the motor being operable to resist while permitting rotation of the upper shaft under the influence of the web on the dancer roll. Further, the air pressure to the air motor is variable to vary the torque on the upper shaft.

Another feature of the invention is the mounting of the dancer roll assemblies. The machine of which the dancer roll assemblies is a part has a combined partition and mounting wall which divides the machine into a sanitary portion and a machinery portion. The dancer roll assemblies are disposed in the sanitary portion and the upper shaft of the dancer roll assembly closest to the wall is hollow and passes through the wall in sealed relation. The outboard upper shaft extends through the inboard upper shaft. The dancer roll assemblies are mounted on the wall by way of a simple support structure formed of a plurality of plates.

With the above, and other objects in view that will hereinafter appear, the nature of the invention will be more clearly understood by reference to the following detailed description, the appended claims and the several views illustrated in the accompanying drawings.

FIG. 1 is an end elevational view of the dancer roll assembly.

FIG. 3 is a fragmentary schematic sectional view taken generally along the line 3—3 of FIG. 2 and shows the specific mounting of the air motors and the coupling thereof to the upper shafts of the dancer roll assemblies.

Figure 2:
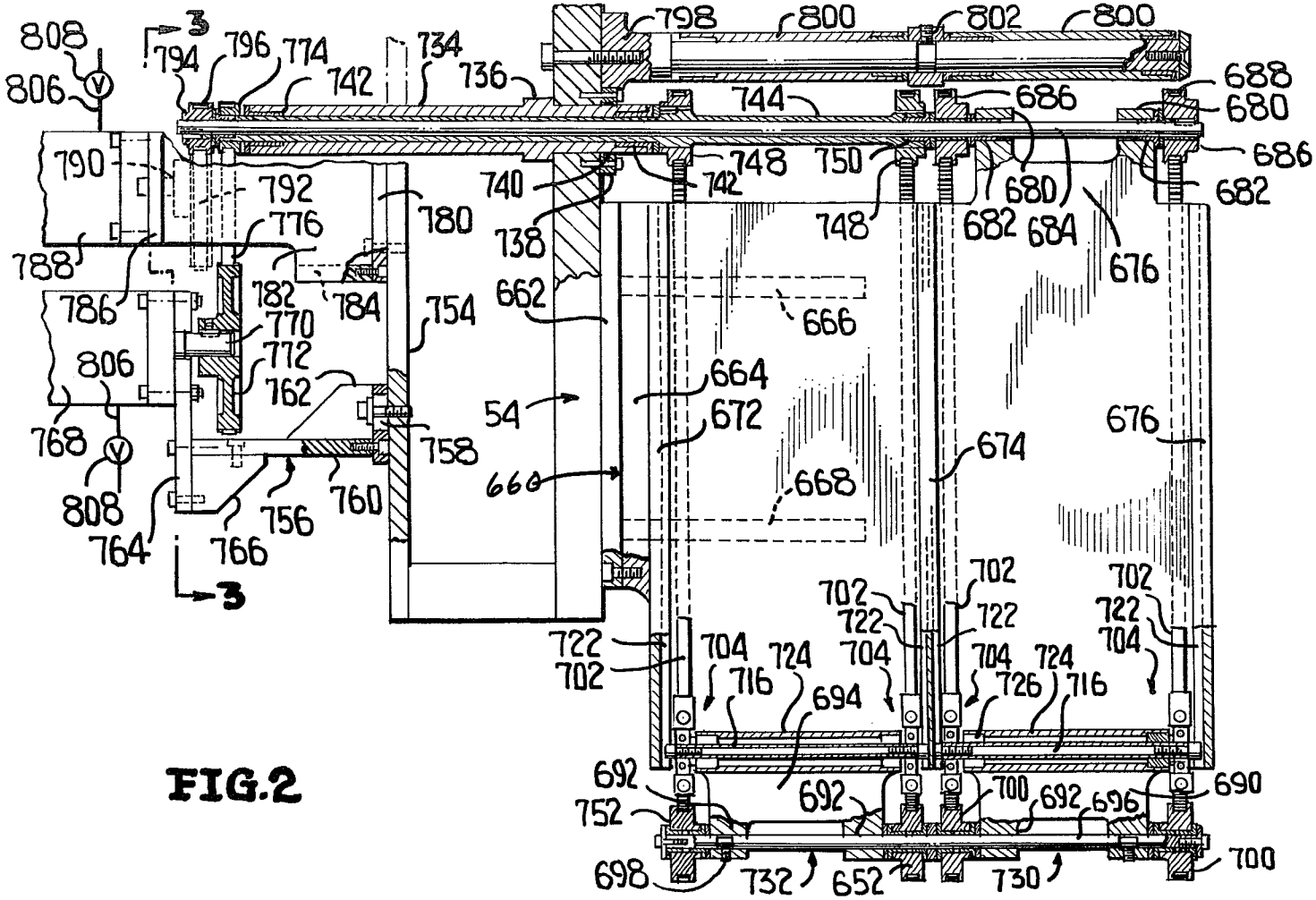
FIG. 2 is a vertical sectional view taken through the machine wall generally along the line 2—2 of FIG. 1 and shows the dancer roll assemblies in elevation, parts being broken away and shown in section.

Referring now to the drawings in detail, it will be seen that the dancer roll assemblies are carried by a support frame assembly, generally identified by the numeral 660. The support frame assembly 660 is mounted on the right side of the machine wall 54.

The support frame assembly 660 includes a mounting plate 662 which is disposed parallel to the wall 54 and is secured thereto in face to face engagement by suitable bolts. A main support plate 664 extends normal to the mounting plate 662 and is secured thereto by means of suitable bolts. The main support plate 664 is reinforced on the back side thereof, as viewed in FIG. 2 by an upper brace plate 666 and a lower brace plate 668, as viewed in FIG. 1. The brace plates 666 and 668 have notches 670 therein for the passage of belts which will be described in detail hereinafter.

The front face of the main support plate 664 has secured thereto bars 672, 674 and 676 which will be described in detail hereinafter. Remote from the wall 54, the plate 664 has projecting upwardly therefrom a shaft mounting portion 678 which terminates in a pair of upstanding arms 680. The arms 680 have bores therethrough and carry bushings 682 in which an upper shaft 684 is rotatably journalled. The shaft 684 carries a pair of sprockets 686 for timing belts with the sprockets 686 having side plates 688 to retain the timing belts thereon.

That part of the support plate 664 disposed remote from the wall 54 also has a depending portion 690 which includes a pair of depending legs 692. In a like manner, that portion of the support plate 664 disposed adjacent the wall 54 also has a depending lower portion 694 which has like legs 692 depending therefrom. The legs 692 have aligned bores passing therethrough and a single elongated lower shaft 696 extends through the legs 692 and is fixed therein by means of set screws 698 carried by remote ones of the legs 692.

A pair of sprockets 700 are rotatably journalled on the shaft 696 in vertical alignment with the sprockets 686. A timing belt 702 is entrained over each pair of the sprockets 686, 700.

With particular reference to the roller part of FIG. 1, it will be seen that remote ends of the belts 702 are secured together by a coupling assembly, generally identified by the numeral 704. The coupling assembly 704 includes an elongated plate 706 which is provided at the opposite ends thereof with transverse grooves 708 which match the ribs on the belt 702. The ends of the belt 702 are assembled with the elongated member 706 and are clamped in place by means of clamp plates 710 which are fixedly secured in position by bolts 712.

A central portion of the elongated member 706 is thickened and has formed in one face thereof a shaft seat 714. An end portion of a dancer roll shaft 716 is seated in the seat and is clamped in place by means of a clamp plate 718 secured to the member 706 by bolts 720.

With reference to FIG. 2, it will be seen that the guide plates 674 and 676 have grooves 722 in the opposed faces thereof and the dancer roll shaft 716 is of a length so as to be received in the grooves which function as guide channels. It is also to be noted that the dancer roll shaft 716 is hollow so as to be light in weight.

The dancer roll shaft 716 has mounted thereon for rotation a dancer roll 724 which is of a tubular construction and which is provided with bearing type plugs 726 in the opposite ends thereof.

Referring once again to FIG. 1 with reference to the upper part thereof, it will be seen that each of the belts may be provided with a second coupling, generally identified by the numeral 728. This coupler will not be described in detail.

It is to be understood that the various components specifically described hereinabove form an outboard dancer roll assembly generally identified by the numeral 730. There is also an inboard dancer roll assembly identified by the numeral 732. The inboard dancer roll assembly, except for some minor details, is identical to the outboard dancer roll assembly.

With reference to the upper part of FIG. 2, it will be seen that the wall 54 has a bearing tube 734 extending therethrough and that the bearing tube 734 is mounted on the wall 54 by means of a mounting flange 736. The bearing tube 734 has telescoped thereover on the opposite side of the wall 54 a cover 738 which is provided with a seal 740 to seal the opening through the wall 54.

The bearing tube or sleeve 734 is coaxial with the shaft 684 and is provided at the opposite ends thereof with bushings 742 in which there is rotatably journalled a second upper shaft 744. An intermediate part of the shaft 744, adjacent the right hand bushing 742 is in the form of a hub 746 on which there is mounted an upper sprocket 748 which corresponds to the sprocket 686. The right end of the shaft 744 carries a bushing 740 which rotatably is journalled to the shaft 744 on the shaft 684 adjacent the left hand sprocket 686. The shaft 744 carries a second upper sprocket 748 adjacent the left hand sprocket 686.

Referring now to the lower part of FIG. 2, it will be seen that the lower shaft 696 has rotatably journalled thereon lower sprockets 752 which are vertically aligned with the upper sprockets 748 and correspond to the sprockets 700. Two additional belts 702 are entrained over the aligned sprockets 748, 752 with the belts being coupled together by like couplers 704. The pair of couplers 704 carry a second dancer roll shaft 716 on which there is mounted for rotation a second dancer roll 724. At this time it is to be noted that the opposed faces of the guide plates 672, 674 are provided with further of the guide grooves 722 and guidingly receive therein remote ends of the second dancer roll shaft 716.

Referring now specifically to the upper left part of FIG. 2 and to FIG. 3, it will be seen that the machine includes a further support plate 754. The support plate 754 is spaced to the left of the wall and is generally parallel thereto. The plate 754 carries a support structure generally identified by the numeral 756 which includes a mounting plate 758 which is removably secured to the left face of the plate 754. The mounting plate 758 carries a horizontal plate 760 which is braced by a vertical brace 762. At the left end of the plate 760 is a vertical plate 764 which is braced by a diagonal plate 766. The plate 764 carries an air motor or actuator 768 which is provided with a shaft 770 having mounted thereon a sprocket 772. The sprocket 772 is aligned with a sprocket 774 carried by the left end of the upper shaft 744. The sprockets 772, 774 are connected together by a drive belt 776.

A further support assembly, generally identified by the numeral 778 is carried by the support plate 754. The support assembly 778 includes a mounting plate 780 which is secured to the left face of the plate 754 in face to face engagement. The plate 780 carries a plate 782 which is vertically disposed and is braced with respect to the plate 780 by a lower horizontal plate 784. At the left end of the plate 782 is a horizontal mounting plate 786 which carries a second air actuator or motor 788.

The air motor or actuator 788 has a shaft 790 on which there is mounted a drive sprocket 792. The drive sprocket 792 is in alignment with a sprocket 794 carried by the left end of the shaft 684 and is coupled thereto by means of a drive belt 796.

The wall 54 has projecting from the right side thereof in cantilever relation a pair of supports 798. On one of these supports 798 there is rotatably journalled a pair of axially spaced idler rolls 800, as is best shown in the upper part of FIG. 2. These rolls are spaced by a spacer 802. The other cantilever support 798 carries a pair of idler rolls 804, as is best shown in the upper part of FIG. 2. Twin webs W, one disposed behind the other, pass from a supply source disposed at the left of the idler rolls 804, over and around the idler rolls 804 and down in front of the dancer rolls 724. The webs then pass below the dancer rolls and up behind the dancer rolls to the right of the idler rolls 800 and then back to the left to a tube forming mechanism which intermittently engage the webs and draw the webs. When the web is drawn, part of the acceleration of the web is absorbed by the dancer rolls which are elevated, rotating the shafts 684, 744 against the resistance of the respective control motors. It is to be understood that the two webs may move independently of one another and that there is no need for the dancer rolls for the two webs to remain in synchronism although they have been so illustrated. The control motors 768 and 786 have coupled thereto a source of air pressure by means of lines 806 having incorporated therein pressure control valves 808. Thus the resistance of the air motors or actuators may be controlled by varying the air pressure. In this manner the torque applied to the shafts 684, 744 may be controlled.

The specific controls for the motors 768, 786 are not a part of this invention and are not specifically described here. It is to be understood, however, that these motors rotate in a drive direction only through a partial revolution so that after the associated dancer roll has moved vertically a prescribed distance, the motor is actuated to drive the respective upper shaft in the necessary direction to return the associated dancer roll to its lower starting position.

It will be readily apparent that the construction of the dancer rolls and the mounting therefor provide for a very light assembly which permits the dancer rolls to be actuated with a minimum of force, thereby not radically affecting the web tension. Accordingly, basically the web tension is therefore a function only of the air pressure directed to the control motors.

Although only a preferred embodiment of the invention has been specifically illustrated and described herein, it is to be understood that minor variations may be made in the dancer roll assembly without departing from the spirit and scope of the invention as defined by the appended claims.

I claim:

1. A dancer roll arrangement for use with a web feeding device, said arrangement comprising upper and lower shafts, axially spaced sprockets on said shafts in vertically aligned relation, endless belts entrained over said aligned sprockets, a dancer roll shaft extending between and secured to said belts in supported relation parallel to said upper and lower shaft, a dancer roll carried by said dancer roll shaft for controlled vertical movement and control means coupled to one of said upper and lower shafts for controlling the rotation thereof.

2. The arrangement of claim 1 wherein said control means is in the form of an oscillating motor normally operating to apply a limited restraining force on said one shaft and being periodically actuated to return said dancer roll to a lower position.

3. The arrangement of claim 2 wherein said motor is a fluid motor and there is a controllable pressure fluid source whereby the restraining force may be adjusted.

4. An arrangement according to claim 1 wherein each belt has incorporated therein a coupler, and said coupler has means for mounting said dancer roll shaft.

5. The arrangement of claim 4 wherein said coupler includes an elongated member, clamp elements at opposite ends of said elongated member fixedly securing thereto opposite end of the respective belt, and said shaft mounting means being carried by an intermediate portion of said elongated member.

6. The arrangement of claim 5 wherein said shaft mounting means includes a shaft seat in said elongated member, and a shaft clamp carried by said elongated member.

7. The arrangement of claim 1 wherein there is a combined partition and mounting machine wall, a support for said upper and lower shafts on one side of said wall, and means supporting said control means on the other side of said wall, and said one shaft extending through said wall in sealed relation.

8. The arrangement of claim 1 together with idler rolls adjacent said upper shaft for guiding a web passing to and from said dancer wall.

9. The arrangement of claim 1 wherein there are two of said upper and lower shafts in side-by-side relation, and there are two of said dancer rolls separably mounted and controlled, one shaft of said second set of shafts being coupled to another control means, and said one shaft being coaxial and including inner and outer shafts.

* * * * *